United States Patent [19]

Mock

[11] Patent Number: 4,573,323

[45] Date of Patent: Mar. 4, 1986

[54] STEAM GENERATING APPARATUS AND METHODS

[75] Inventor: Edward A. Mock, Phoenix, Ariz.

[73] Assignee: The Garrett Corporation, Los Angeles, Calif.

[21] Appl. No.: 397,749

[22] Filed: Jul. 13, 1982

[51] Int. Cl.[4] ..... F01K 13/02

[52] U.S. Cl. ..... 60/665; 60/654; 60/670; 60/667; 122/406 B; 122/407; 122/414; 122/451 Z

[58] Field of Search ..... 122/406 R, 406 B, 414, 122/451 R, 451 Z, 407; 60/664, 665, 667, 670, 654

[56] References Cited

U.S. PATENT DOCUMENTS

| | | | |
|---|---|---|---|
| 2,116,587 | 5/1938 | Toensfeldt | 60/664 |
| 2,679,831 | 6/1954 | Henkel | 122/406 R |
| 3,103,917 | 9/1963 | Bauer et al. | 122/407 X |
| 3,478,726 | 11/1979 | Kikinis | 122/407 X |
| 3,575,144 | 4/1971 | Takahashi et al. | 122/406 R |

*Primary Examiner*—Allen M. Ostrager

*Attorney, Agent, or Firm*—Terry L. Miller; Albert J. Miller

[57] ABSTRACT

Steam generating apparatus and methods wherein a liquid is recirculated within a boiler by use of a constant speed dynamic feed water pump acting both to feed the boiler and to effect recirculating therein by a jet pump with its jet nozzle in liquid flow series with the dynamic pump. The jet pump also receives water from a steam drum for recirculation through the boiler. In the event of excess feed water supply to the boiler a step-function level control for the steam drum bypasses liquid to a condenser. A second jet pump acts to utilize excess feed water to supply cool water from the condenser well under pressure to the dynamic pump so that no water is bypassed to the condenser under on-design operating conditions. For waste heat recovery to provide shaft power automatically with simplified controls.

50 Claims, 3 Drawing Figures

STEAM GENERATING APPARATUS AND METHODS

BACKGROUND OF THE INVENTION

The Government has rights in this invention pursuant to Contract No. N00024-80-C-5350 awarded by the U.S. Navy.

The field of this invention is steam generating apparatus and methods. More particularly, this invention relates to a steam generating apparatus having a boiler wherein pressurized water to be vaporized is recirculated through the boiler by a recirculation pump. A feed water pump delivers the water to the boiler. The boiler includes a steam drum wherein steam is collected for delivery to a steam utilizing device. The flow rates of liquid to and vapor from the boiler determine the liquid level in the steam drum.

Conventional steam generating apparatus having a recirculating boiler commonly employ an externally powered pump recirculating liquid within the boiler and a separate externally powered liquid feed pump supplying liquid to the boiler from a low pressure source. Each of these pumps is subject to leakage and is a portion of the apparatus which requires considerable maintenance effort and time. Further, in order to facilitate maintenance of such pumps and allow rapid removal of a defective pump and substitution of a replacement pump, the piping leading to and from each pump must include a joint which may be disconnected. Still further, such piping must include a shut off valve both upsteam and downstream of each pump. Good piping practice also dictates that where a pump or other component is to be removed from a pipe section, a bypass loop and valve must be provided so that circulation flow may be maintained through the pipe. In some applications, a shut off valve must also be provided both upstream and downstream of each pump for removal from the pipe section along with the pump so that the contents thereof is not spilled when the pipe joints are opened. All in all, such a conventional steam generating apparatus includes at least two pumps each having as many as two joints and five valves associated therewith. Because such pumps are prone to failure, conventional steam generating apparatus may include auxiliary pumps along with piping to provide alternative flow paths to and from the auxiliary pumps. Of course such redundancy also causes a great increase in the complexity, expense, and number of leakage paths of the steam generating apparatus.

Some conventional steam generating apparatus also include a system of pressure sensors, temperature sensors, and fluid flow sensors which provide information to a processor controlling the operation rate of a liquid feed pump in order to control the rate of liquid supply to their boilers. Such a variable rate liquid feed pump must be of the positive displacement type so that the operating rate thereof dictated by the processor results in a predetermined rate of liquid flow into the boiler. Such a positive displacement liquid feed pump is generally complex and subject to wear and failure. Moreover, such a complex and expensive control scheme is also subject to failures which may render the steam generating apparatus inoperable.

U.S. Pat. Nos. 3,413,809; 3,315,466, 1,930,064; 1,148,316; 2,457,388; 3,441,045; 1,350,095; 1,421,841; 1,421,848; 1,814,120; 1,993,478 and 2,987,007 illustrate subject matter which the applicant believes may be relevant to this invention.

SUMMARY OF THE INVENTION

This invention provides steam generating apparatus and methods wherein heat exchange structure places a liquid in heat exchange relation with a source of heat to promote boiling of the liquid. A collecting structure in association with the heat exchange structure receives heated liquid from the latter and collects the vapor resulting from boiling of the liquid. A first pump pressurizes liquid from a low pressure source thereof and delivers the pressurized liquid to the heat exchange structure. A second pump recirculates liquid from the collective structure to the heat exchange structure in response to the flow of pressurized liquid from the first pump.

Further to the above, the invention provides a sensor responsive to the liquid level within the collecting structure to produce a control signal. A valve controlled by the control signal from the sensor regulates a flow of liquid from the collecting means to the low pressure source to control the liquid level within the collecting means. A third pump utilizes a flow of pressurized liquid from the collecting structure to assist delivery of low pressure liquid from the source thereof to the first pump. The third pump includes an adjusting apparatus responsive to the pressure level within the collecting structure to adjust the flow rate of pressurized liquid utilized by the third pump.

DETAILED DESCRIPTION OF THE PREFERRED EMBODIMENT

Figure 1:
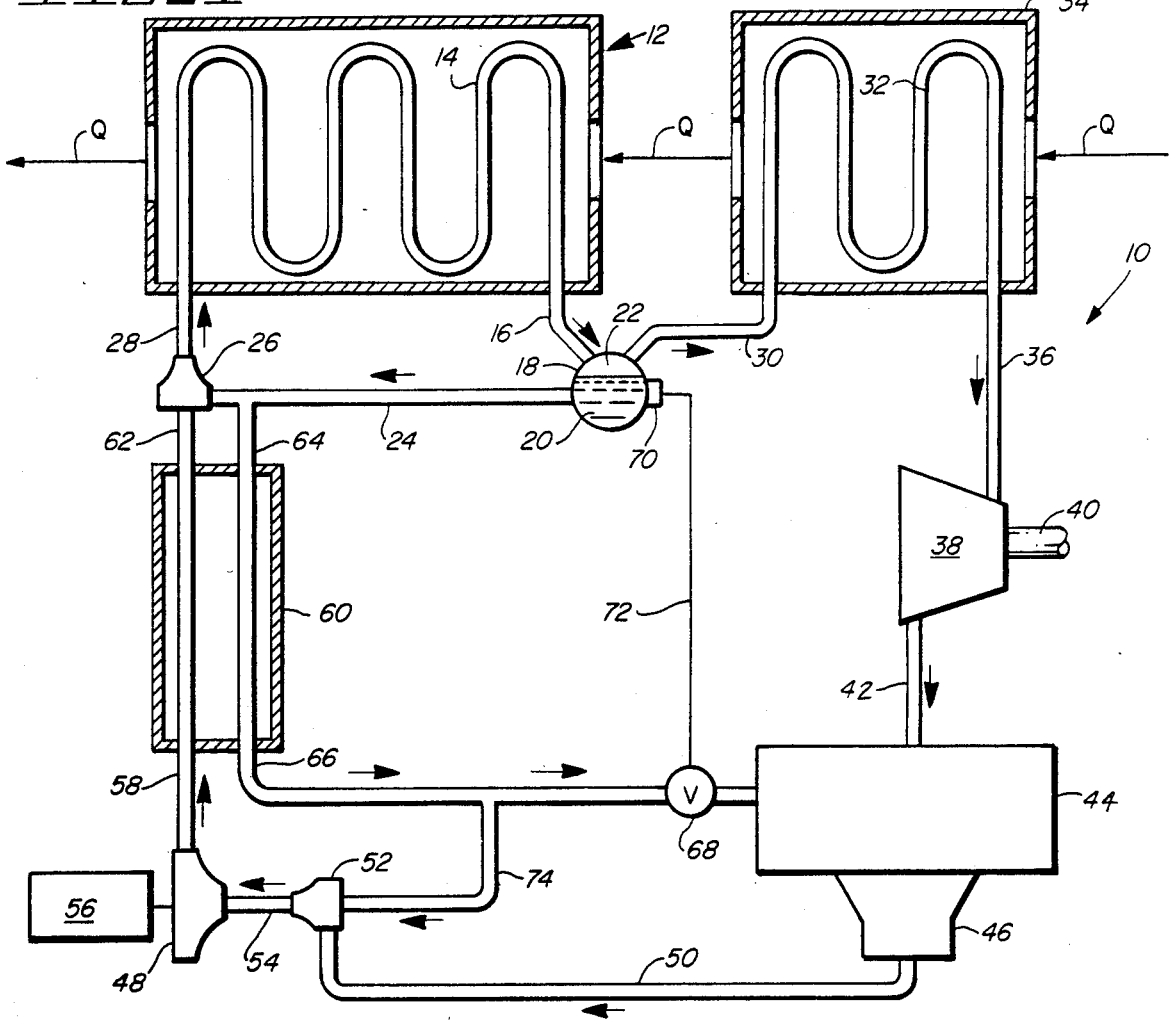
FIG. 1 is a block diagram schematically illustrating a steam generating apparatus according to the invention.

FIG. 1 illustrates one preferred embodiment of the invention which is described in detail below. In the following detailed description the term "steam" includes not only vaporized water but also the vapor phase of any liquid undergoing a liquid-to-vapor phase change at uniquely related combinations of temperature and pressure. There is depicted a steam generating apparatus 10 having a boiler 12 including boiler tubes 14. The tubes 14 are externally exposable to a flow of high temperature gases, as is represented by arrows Q. At a high temperature end, the boiler tubes 14 communicate via a conduit 16 with a steam drum 18 which is, of course, a part of the boiler 12. During operation of the apparatus 10, the steam drum 18 is partially filled with pressurized liquid 20. Above the liquid 20 a steam space 22 is defined within drum 18. A conduit 24 communicates with the interior of the steam drum 18 below the level of liquid 20. Conduit 24 leads to the inlet of a recirculation jet pump 26. A conduit 28 communicates the outlet of the pump 26 with the other or low temperature end of the boiler tubes 14.

From the steam drum 18 a conduit 30 leads from steam space 22 to the high temperature end of the tubes 32 of a superheater 34. The superheater 34 is upstream of and in series with the boiler 12 with respect to the flow of hot gases Q. Consequently, the tubes 32 are exposed to the highest temperature gases Q. A conduit 36 connects to the other ends of the tubes 32 of superheater 34.

The conduit 36 leads to a continuously open, fixed-area nozzle assembly (not shown) of a steam turbine 38. The turbine 38 includes a drive shaft 40 by which the turbine 38 may be connected to drive a power-absorbing load (not shown).

From steam turbine 38, a conduit 42 leads to a condenser 44. The condenser 44 includes condenser tubes (not shown) carrying cooling liquid. Thus, any steam which is admitted to condenser 44 during operation of the apparatus 10 is condensed to liquid and drops into a well portion 46 of condenser 44.

In order to maintain the boiler tubes 14 substantially full of liquid during operation of apparatus 10, a constant speed dynamic liquid feed pump 48 draws liquid from the well 46 via a conduit 50, through a variable jet pump 52 which is to be described in greater detail infra, and through a conduit 54; as is illustrated by arrows, viewing FIG. 1. The pump 48 is of the constant-speed dynamic pressure generating type whose discharge flow rate is a function of the pressure differential thereacross. For example, the pump 48 may be of the centrifugal type having one or more stages. An electric motor 56 drives the pump 48. A conduit 58 communicates pressurized liquid from the pump 48 to a heat exchanger 60. From the heat exchanger 60, a conduit 62 communicates the pressurized liquid to the nozzle inlet of the recirculation jet pump 26.

The pump 26 is a jet pump of conventional design. Pump 26 is welded into the conduits 24, 28 and 62 and has a ratio of nozzle area to throat area of about 0.1. The nozzle of jet pump 26 is disposed to direct a high velocity jet of liquid from pump 48 toward conduit 28 during operation of the apparatus 10. Consequently, the jet of liquid entrains liquid from steam drum 18 communicated to pump 26 via conduit 24 and recirculates such entrained liquid through boiler tubes 14 and back to steam drum 18. Further, jet pump 26 cooperates with dynamic pump 48 to establish the rate of liquid flow from the latter into boiler 10, as is explained in greater detail infra.

A conduit 64 connects with conduit 24 and leads to the heat exchanger 60. Conduit 64 communicates with a conduit 66 leading from the heat exchanger 60 to condenser 44 via a control valve 68. Thus, liquid traversing the heat exchanger 60 via conduits 58 and 62 is in heat exchange relation with liquid flowing via conduits 64 and 66.

A liquid level sensor 70 is mounted on steam drum 18 to sense the liquid level therein. The sensor 70 controls valve 68 via on interconnection 72 to control the liquid level in drum 18 within a predetermined range.

A conduit 74 connects with conduit 66 and leads to the nozzle inlet of the variable jet pump 52. Viewing FIG. 2, it will be seen that variable jet pump 52 includes a housing 76 including a first part 78 and a second part 80 which are threadably connected at 82. The housing part 78 defines a nozzle inlet 84 and is welded to conduit 74. Similarly, the housing part 80 defines an inlet 86 and an outlet 88 and is welded respectively to conduits 50 and 54 so as to communicate therewith. The housing 76 defines a vestibule or chamber 90 communicating with inlet 86 and leading to a throat 92. The throat 92 leads to a divergent diffuser section 94 communicating with outlet 88.

A pressure responsive variable nozzle assembly 96 is carried by the housing 76. The nozzle assembly 96 includes an annular outer nozzle portion 98 extending through the chamber 90 and into a convergent section 100 of housing 76. The nozzle portion 98 defines an aperture 102 at the downstream end thereof which is concentric with the center of throat 92. A hollow streamlined body 104 is concentrically supported within the nozzle portion 98 by a multitude of struts 106 (only two of which are visible viewing FIG. 2). The streamlined body 104 cooperates with the nozzle portion 98 and with body 76 to define an annular flow path 108 communicating inlet 84 with aperture 102.

The streamlined body 104 defines a chamber 110 therein and an axially extending bore 112 opening from chamber 110 toward and concentric with aperture 102. The body 104 also defines an axially extending guide portion 114 defining a bore 116 therein axially aligning with bore 112. An elongate needle valve member 118 including a stem portion 120 and a needle valve element portion 122 is slidably received in the bores 116, 112, respectively. The stem portion 120 carries an annular spring seat 124 which is engageable with the guide portion 114 to define a retracted position for the needle valve member 118. In the retracted position of member 118 a conical end portion 126 of valve element 122 is disposed relative to aperture 102 so that the point of valve element portion 122 is substantially coextensive with the plane of aperture 102. A coil spring 128 extends from a radially inwardly extending flange 130 of the body 104 to the spring seat 124 to bias the latter leftwardly into engagement with guide portion 114. The body 104 defines a second radially inwardly extending flange 132 which confronts an annular flange 134 carried on needle valve member 118. A coannular pair of bellows members 136, 138 extend between the flanges 132, 134 and sealingly cooperate therewith to define an annular chamber 140 which is substantially evacuated. The body 104 also defines a number of passages 142, 144 opening from the flow path 108 to the chamber 110. Thus, the chamber 110 is exposed to pressure from the steam drum 18 (allowing for any small pressure drops occurring therebetween due to fluid flow).

Having observed the structure of the apparatus 10, attention may now be directed to its operation. Turning once again to FIG. 1, when the apparatus 10 is to be brought into operation, a flow of high temperature gases Q is directed through the superheater 34 and boiler 12 and the motor 56 of pump 48 is energized. When the pump 48 begins operation, it pumps liquid from well 46 through heat exchanger 60 and jet pump 26 into the tubes 14 of boiler 12. From the tubes 14 liquid flows to steam drum 18 via conduit 16. A portion of this liquid from steam drum 18 is recirculated through the boiler tubes 14 by recirculation jet pump 26, as explained supra. However, because at the outset of operation of apparatus 10 the boiler 12 has not reached a sufficiently high temperature to cause boiling of the liquid therein, the steam pressure in space 22 is substantially zero. Thus, the steam flow from steam drum 18 through turbine 38 to condenser 44 is also substantially zero. Consequently, the rate of liquid inflow to boiler 12 from pump 48 far exceeds the rate of steam generation in and steam flow from the boiler. These initial start-up conditions of apparatus 10 are illustrated on the graph of FIG. 3 wherein line 146 represents the inherent liquid flow rate versus pressure characteristic of dynamic pump 48. Line 148, which is one of a family of similar characteristic lines, represents the inherent liquid flow versus pressure characteristic of the nozzle of recirculation jet pump 26. Of course, the rate of liquid flow through pump 48 and through the nozzle of jet pump 26 must be equal because they are in liquid flow series with one another. Thus, at initial start-up of apparatus 10, the steam pressure in steam drum 18 and the steam flow therefrom are substantially zero (represented at the origin of the graph of FIG. 3). On the other hand, the liquid flow rate from pump 48 to steam drum 18 is represented by a point 150 which is vertically below a point 152 at the intersection of lines 146 and 148.

Because at initial start-up of apparatus 10, the rate of liquid inflow to steam drum 18 is relatively great while the rate of steam generation therein is almost nill, the liquid level sensor 70 cycles valve 68 open and closed to maintain the liquid level in drum 18 within the predetermined range by draining liquid to condenser 44. The sensor 70 and valve 68 are of the step function or on-off type. During start-up of the apparatus 10, the proportion of time, or duration, that valve 68 is open is relatively great.

As the temperature of boiler 12 increases in response to the flow of hot gases Q, boiling commenses in tubes 14. Because the tubes 14 are substantially filled with liquid, the boiling which occurs therein is of the stable nucleate type. Consequently, the boiler 12 provides a relatively high rate of heat transfer between the hot gases Q and the liquid within tubes 14.

Figure 3:
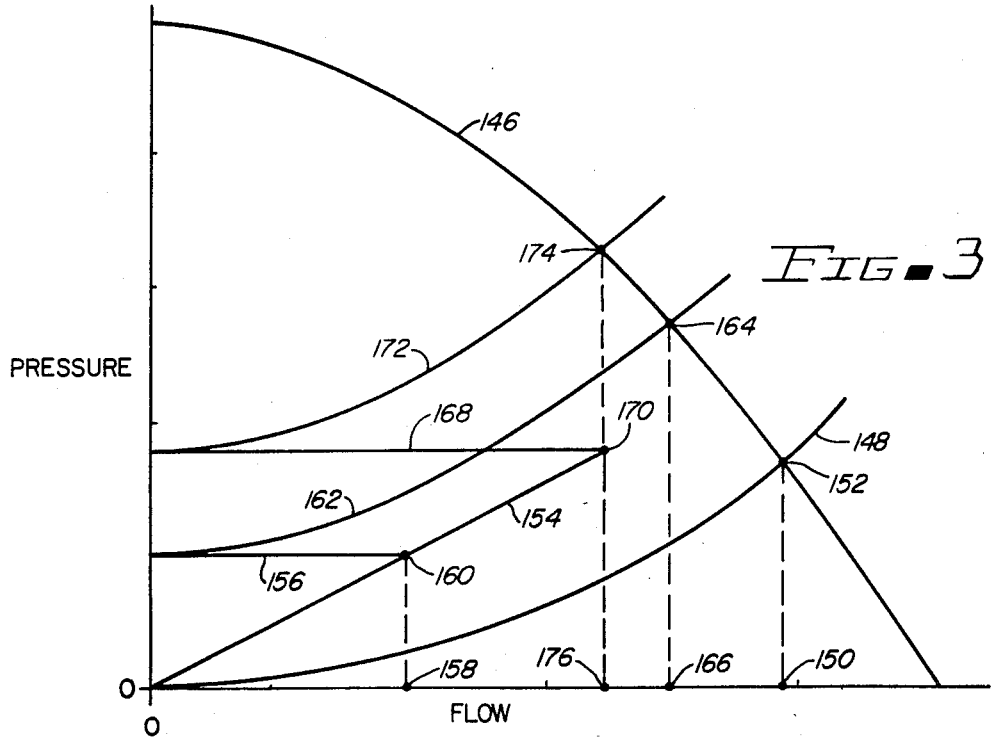
FIG. 3 is a graph illustrating the operating characteristics of several of the component parts of the apparatus which is depicted in FIG. 1.

Above the liquid 20 in steam drum 18 a quantity of pressurized saturated steam accumulates in space 22. Saturated steam flows from space 22 to tubes 32 of superheater 34 via conduit 30. The tubes 32 are upstream of and in series with the tubes 14 with respect to the flow of hot gases Q. Consequently, the tubes 32 are exposed to the highest temperature gases Q to superheat the pressurized steam therein. Superheated steam exits the superheater 34 via conduit 36 and is communicated to the continuously open, fixed area nozzle assembly of turbine 38. Because the nozzle assembly of turbine 38 is designed to operate as a choked nozzle at all differential pressures thereacross greater than a relatively low value, the steam flow rate therethrough is an essentially linear function of steam saturation pressure within steam drum 18. In other words, the steam flow rate from steam drum 18 through superheated 34 and turbine 38 to condenser 44 is an almost linear function of the driving force provided by steam pressure in drum 18. Line 154 of FIG. 3 illustrates the relationship of steam flow rate through turbine 38 to steam pressure in steam drum 18. Conversely, line 154 also illustrates that saturation steam pressure in the steam drum 18 is essentially a linear function of the steam flow rate through turbine 38.

An illustrative operating level of apparatus 10 is depicted on FIG. 3, wherein horizontal line 156 represents a particular steam saturation pressure within steam drum 18. A point 158 vertically below a point 160 at the intersection of lines 154 and 156 defines the rate of steam flow through turbine 38 at the illustrative operating level of apparatus 10. A characteristic line 162, which is one of the family of similar lines including line 148, is coincident with line 156 at the ordinate of the graph of FIG. 3 and represents the inherent liquid flow rate versus pressure characteristic of the nozzle of jet pump 26. The line 162 intersects line 146 at a point 164. The vertical distance between line 156 (saturation steam pressure in steam drum 18) and point 164 is indicative of the pressure drop across the nozzle of jet pump 26. A point 166 vertically below the point 164 defines the rate of liquid flow from pump 48 to the boiler 12 at the illustrative operating level of apparatus 10.

It will be noted upon examination of FIG. 3 that at initial start-up of the apparatus 10, the liquid flow rate to boiler 12 was represented by point 150 while the steam flow rate therefrom was essentially zero (at the origin of the graph of FIG. 3). On the other hand, at the illustrative operating level and steam saturation pressure within drum 18 described above, the liquid flow rate to boiler 12 from pump 48 is represented by point 166 while the steam flow rate from drum 18 is represented by point 158. In other words, the points representing the liquid flow rate to and the steam flow rate from boiler 12 move toward one another on the graph of FIG. 3 as the operating level of apparatus 10 and the steam saturation pressure within drum 18 increase.

In light of the above, it is easily appreciated that at a predetermined maximum operating level for the apparatus 10, the points on FIG. 3 representative of liquid flow to and steam flow from boiler 12 will be coincident. Such a coincidence is illustrated in FIG. 3 by steam drum saturation pressure line 168 which intersects steam turbine flow characteristic line 154 at a point 170. A characteristic line 172, one of the family of lines including lines 148 and 162, intersects line 146 at a point 174. The point 174 is vertically above the point 170 and a point 176 representative of a predetermined maximum operating level and steam drum saturation pressure flow rate for the apparatus 10. At the point 176 the rate of steam flow from steam drum 18 is at a maximum level and is equal to a minimum rate of liquid flow from dynamic pump 48 to boiler 12.

Because the steam saturation pressure within steam drum 18 is ultimately a function of the heat energy available from the flow of hot gases Q, the operating level of the apparatus 10 varies both upwardly (higher steam saturation pressure) and downwardly (lower steam saturation pressure) according to the relationships described above as the heat energy of the gases Q varies. That is, as the level of available heat energy from gases Q varies, the steam flow rate from boiler 12 and the shaft power output of turbine 12 inherently vary between zero and the rate represented by point 176 and steam pressure line 168, viewing FIG. 3. The liquid flow rate to the boiler 12 inherently varies between the rates represented by points 150 and 176.

During operation of apparatus 10 at all levels lower than that represented by line 168 and point 176 of FIG. 3, the horizontal distance between the point representing liquid flow rate to boiler 12 and the point representing steam flow rate therefrom (e.g. points 158 and 166, for example) represents the rate at which liquid must be removed from steam drum 18 in order to maintain the liquid level therein within the predetermined range. Thus, it may be appreciated that while during start-up of apparatus 10 the valve 68 is open a large proportion of the time, during operation at the maximum level indicated by point 174, valve 68 does not open at all. During operation of apparatus 10 at levels between start-up and the maximum level as indicated by point 174, the proportion of the time that valve 68 is open varies according to the operating level of the apparatus.

Further consideration of FIG. 1 will make apparent that when the valve 68 opens to drain liquid from steam drum 18, the draining liquid carries both heat and pressure energy from boiler 12 toward condenser 44. The heat exchanger 60 recovers a major part of the heat energy carried by the draining liquid. Heat exchanger 60 transfers heat energy from draining liquid to relatively cool boiler feed liquid traveling from pump 48 toward pump 26. However, when the valve 68 opens the pressure energy carried by the draining liquid is dissipated within condenser 44 by a spray nozzle therein (not shown) receiving the pressurized draining liquid from conduit 66.

In order to recover a portion of the pressure energy of liquid flowing in conduit 66 toward condenser 44 by reducing the proportion of time that the valve 68 is open, the invention provides the conduit 74 and variable jet pump 52. It can be readily seen that liquid flow from conduit 66 through conduit 74 will reduce the necessary duration of liquid flow through valve 68. In other words, flow in conduit 74 reduces the porportion of time that valve 68 is open and similarly reduces the time average rate of liquid flow to condenser 44 via conduit 66. Further, liquid flow through conduit 74 has the effect of reducing the liquid flow rate in conduit 50 with the liquid flow rate in conduit 54 being equal to the predetermined rate of liquid flow from pump 48 to boiler 12. As explained supra, this latter rate, the rate of liquid flow from pump 48 to boiler 12, is a function of the steam saturation pressure within steam drum 18; and of the operating level of apparatus 10.

Figure 2:
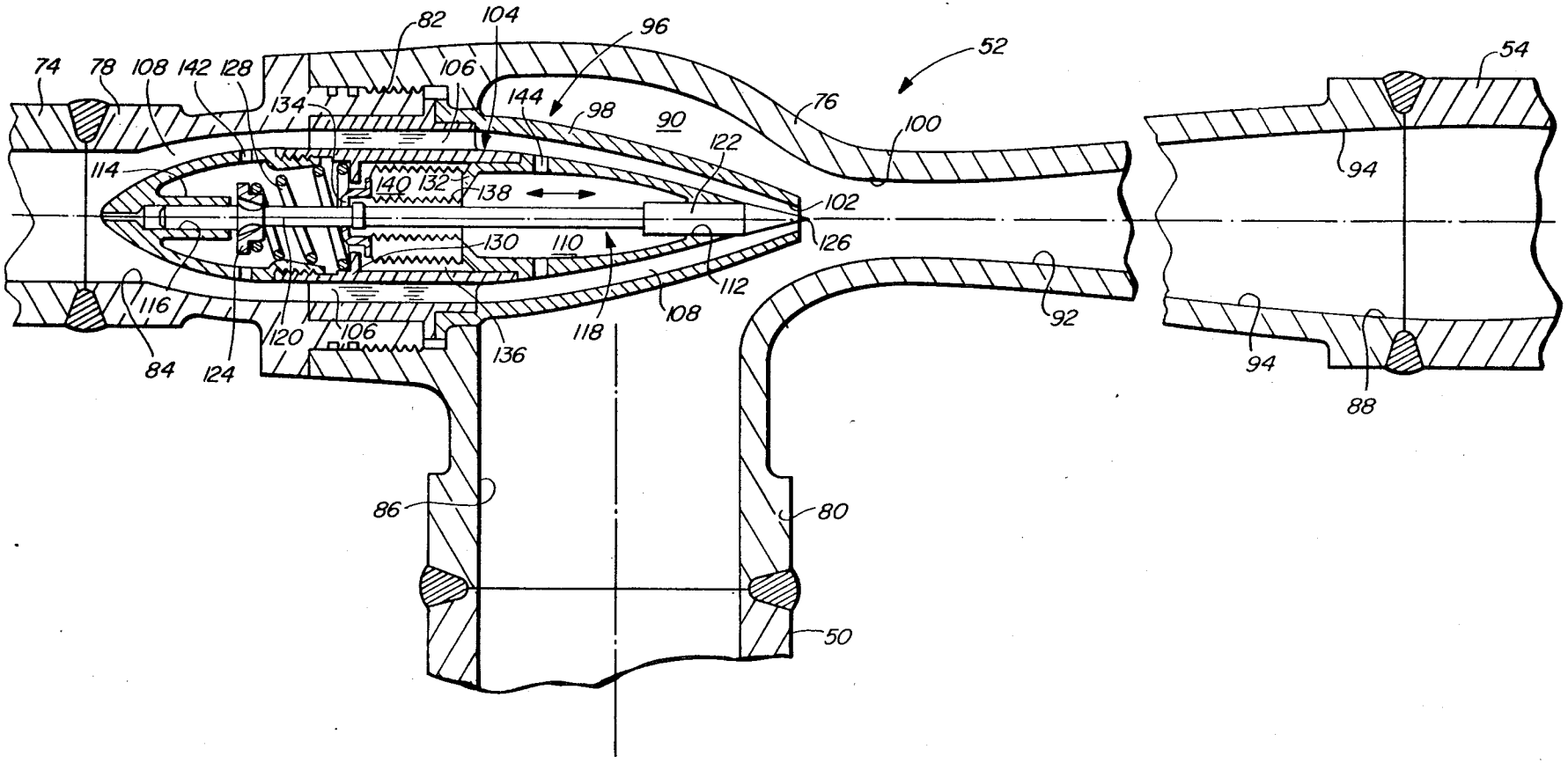
FIG. 2 illustrates a longitudinal view, partly in cross section, of a variable jet pump according to the invention.

Viewing FIG. 2, the nozzle assembly 96 of jet pump 52 receives a flow of pressurized liquid from conduit 74 and converts a portion of the pressure energy of the liquid to kinetic energy to form a high velocity liquid jet issuing from aperture 102. The high velocity liquid jet entrains liquid from conduit 50 to induce a liquid flow in the latter. The jet of liquid from conduit 74 mixes with and increases the pressure of liquid from conduit 50 and flows together therewith to the inlet of dynamic pump 48 via conduit 54. Thus, the pressure energy of liquid from conduit 66 is employed by the invention to increase the pressure level at the inlet of dynamic pump 48. The increased liquid pressure at the inlet of pump 48 has the effect of preventing cavitation in the pump and also of reducing the power required of motor 56 to drive the pump 48.

While it is desirable at relatively low operating levels of apparatus 10 to utilize a relatively large flow rate of liquid from conduit 66 in the nozzle assembly of jet pump 52 (i.e. according to the excess rate of liquid inflow to boiler 12 recalling the explanation supra pertaining to FIG. 3), to do so at higher operating levels when the excess liquid inflow to boiler 12 is less would result in the liquid level in steam drum 18 dropping too low and out of the predetermined range.

Accordingly, the variable jet pump 52, viewing FIG. 2, provides a liquid flow area at aperture 102 which is about equal to or greater than 0.2 of the area of throat 92. At low pressure differentials across the nozzle assembly 96 (i.e. low steam saturation pressure levels), this relatively large area ratio of pump 52 results in a relatively low velocity jet of liquid which entrains comparatively little liquid from conduit 50 (i.e. from condenser well 46). Thus, at steam saturation pressures within drum 18 which are below a certain level, a substantial portion of the liquid flow in conduit 54 issuing from jet pump 52 is provided via aperture 102 from conduit 74 and steam drum 18. Consequently, under these start-up and low level operation conditions the jet pump 52 reduces the time average flow rate through the valve 68. In other words, because of the jet pump 52, a lesser quantity of liquid is drained to condenser 44 from steam drum 18 per unit of time so that less energy is wasted in controlling the liquid level within steam drum 18. It can easily be appreciated that all of the pressure and heat energy of the liquid flowing in conduit 74 is conserved because this liquid is returned to boiler 12 by pump 48.

However, at higher operating levels of the apparatus 10, whereat the steam saturation pressure within drum 18 is commensurately higher also, the aperture 102 is so large that an excessive flow of liquid through conduit 74 could result and drain the liquid level of steam drum 18 too low. In order to prevent such excessive draining of the steam drum 18, whenever the steam saturation pressure therein exceeds the certain level, such pressure in chamber 110 of jet pump 52 begins to collapse the chamber 140 in opposition to spring 128 to move the needle valve member 118 rightwardly, viewing FIG. 3. As the needle valve member 118 moves rightwardly, the conical end 126 thereof moves into aperture 102 to reduce the effective area thereof and the liquid flow rate in conduit 74. The spring rate and preload of spring 128 is selected in view of the effective annular area defined by the bellows 136, 138 and the taper of the conical end 126 of valve element 122 so that at a predetermined maximum saturation pressure the fluid flow area at aperture 102 is reduced to about one-quarter or less of the full area of the aperture. Thus, the nozzle area ratio of the jet pump 52 is reduced to about 0.05 from 0.2 or higher. The affect of this change in nozzle area of jet pump 52 and of the increased pressure differential across the aperture 102 is to increase the pumping efficiency of the jet pump 52. Thus, a larger proportion of the fluid flow in conduit 54 flows via conduit 50 and originates in condenser well 46. Under these conditions, which are the maximum saturation pressure operating conditions for the engine 10, the fluid flow rate in conduit 50 substantially matches the flow rate of vapor from drum 18 via conduit 30 and turbine 38 to condenser 42. Accordingly, the liquid level in drum 18 remains substantially constant. Thus, the control valve 68 opens only rarely and substantially no liquid is drained from drum 18 into condenser 42.

It is easily appreciated in light of the above that the evacuated chamber 140 of variable jet pump 52 provides a pressure reference for the entire engine 10. That is, the fluid flow rates in conduit 50 and 74 are determined by reference to the pressure (vacuum) of chamber 140. While this invention has been described with reference to a preferred embodiment thereof having chamber 140 evacuated, it is to be understood that a pressure-responsive medium could be used in chamber 140. That is, a gas or mixture of gases can be used in chamber 140 with the spring rate and preload of spring 128 adjusted accordingly. Thus, the apparatus 10 may be modified to function under a variety of conditions and with a variety of working fluids. For example, ammonia may be used in apparatus 10 if it is desired to produce shaft energy using a relatively low temperature source of heat energy. Alternatively, the chamber 140 may be communicated with the interior of condenser 44. Because during operation of the apparatus 10 the pressure within condenser 46 is relatively low (i.e. almost completely evacuated when the working medium of the apparatus is water). Such a connection provides an effectively infinite vacuum source for the chamber 140. Thus, a minor leak of the chamber 140 will not result in significant loss of function of the jet pump 52.

While other fluids may be used in the apparatus 10, water is, of course, the preferred working fluid for use in apparatus 10. With water as the working fluid, apparatus 10 is particularly well suited for use in conjunction with a combustion turbine engine. Such combustion turbine engines provide great quantities of heat energy in their exhaust flow which is ordinarily wasted. Such exhaust flow may be used in the invention as the flow of hot gases Q. By providing a temperature-responsive switch exposed to the flow of gases Q to turn motor 56 on and off, viewing FIG. 1, the apparatus 10 will operate to produce shaft power completely without supervision and with great reliability.

Such reliability of the apparatus 10 is enhanced because the turbine 38 has a fixed-area nozzle assembly and requires no governor or throttle control device. Both of the jet pumps 26 and 52 are welded into the associated piping so that fluid leakage is virtually eliminated. The dynamic pump 48 may be of the centrifugal type which is simple in construction and not prone to failure. Finally, the sensor 70 and valve 68 are of the step-function, on-off type which also may be made very reliable. The only part of the apparatus 10 utilizing proportional interaction type of control is the variable jet pump 52. As can be seen by examination of FIG. 2, the jet pump 52 accomplishes such proportionate control through the use of mechanically simple and rugged structure. Further, in the event that pump 52 does fail to provide proportionate control, the apparatus 10 is still operable without supervision, albeit at a somewhat reduced efficiency, with the sensor 70 and valve 68 controlling the liquid level in drum 18.

In view of the above, it is apparent that this invention provides steam generating apparatus and method. While this invention has been depicted and described with reference to a preferred embodiment thereof, such reference does not imply a limitation upon the invention and none is to be inferred. The invention is intended to be limited only by the scope and spirit of the appended claims which provide a definition of the invention.

I claim:

1. Apparatus comprising heat exchange means for placing a liquid in heat exchange relation with a source of heat to promote boiling of said liquid, collecting means in association with said heat exchange means for receiving heated liquid from the latter and collecting the vapor resulting from boiling of said liquid, liquid feed means for pressurizing liquid from a low pressure source thereof and for delivering a flow of said pressurized liquid to said heat exchange means, and means for recirculating liquid from said collecting means to said heat exchange means in response to said flow of pressurized liquid, said apparatus further includes a sensor responsive to a liquid level in said collecting means to produce a signal, means defining a liquid flow path from said collecting means to said low pressure liquid source, and valve means opening and closing said liquid flow path in response to said signal thereby to limit the liquid level in said collecting means, wherein said liquid feed means draws liquid from said low pressure liquid source via a jet pump for delivery to said heat exchange means, said liquid flow path including a branch upstream of said valve means which communicates with a high pressure inlet of said jet pump, whereby pressurized liquid flow from said collecting means to said liquid feed means via said jet pump entrains liquid from said low pressure liquid source and flows therewith to said liquid feed means.

2. The invention of claim 1 wherein said liquid feed means has a substantially constant speed of operation and a liquid flow rate therethrough which is inversely dependent upon fluid pressure in said collecting means.

3. The invention of claim 2 wherein said liquid feed means includes a centrifugal type rotaty pump.

4. The invention of claim 1 wherein said apparatus further includes another heat exchange means interposed both between said liquid feed means and said heat exchange means and in said liquid flow path upstream of said valve means for transferring heat energy therebetween.

5. The invention of claim 1 wherein said apparatus further includes a vapor utilizing device receiving a flow of vapor from said collecting means.

6. The invention of claim 5 wherein said vapor utilizing device comprises a fluid turbine.

7. The invention of claim 6 wherein said fluid turbine includes a continuously open fixed-area nozzle assembly controlling the fluid flow rate through said turbine in direct dependence upon the fluid pressure differential thereacross.

8. The invention of claim 7 wherein said fluid turbine exhausts vapor to a condenser associated with said low pressure liquid source, liquid condensed from said vapor flowing from said condenser to said low pressure liquid source.

9. The invention of claim 8 wherein said jet pump includes control means for adjusting the flow rate of liquid from said collecting means to said liquid feed means as a function of the fluid pressure in said collecting means.

10. The invention of claim 9 wherein said control means includes means defining a liquid flow aperture communcicating in liquid flow series with said high pressure inlet of said jet pump, and means for reducing the effective liquid flow area defined at said aperture in dependence upon the fluid pressure within said collecting means.

11. The invention of claim 10 wherein said valve element includes a conical portion movable into and out of said liquid flow aperture to vary the effective liquid flow area defined thereat.

12. The invention of claim 10 wherein said reducing means includes a valve element movable into said aperture so as to reduce the effective liquid flow area defined thereat, and means for moving said valve element.

13. The invention of claim 12 wherein said moving means includes structure defining a resilient variable-volume chamber operatively associated with said valve element, resilient means biasing said valve element to a first position wherein the latter is substantially removed from said liquid flow aperture, and liquid flow path means exposing said structure to fluid pressure within said collecting means, said fluid pressure collapsing said variable-volume chamber in opposition to said resilient means to move said valve element into said liquid flow aperture to a second position, said valve element in said second position thereof reducing said effective flow area of said aperture in dependence upon said fluid pressure level.

14. The invention of claim 13 wherein said resilient variable-volume chamber is substantially evacuated.

15. The invention of claim 13 wherein said resilient variable volume chamber is substantially defined by a pair of coannular bellows members.

16. In a steam generator comprising a boiler with steam receptacle means receiving both pressurized liquid and vapor for substantially separating same, the method of controlling the liquid level within said steam receptacle means comprising the steps of:

utilizing a dynamic liquid pressure generating pump to supply pressurized liquid from a relatively low pressure source to said boiler;

utilizing a flow-restricting orifice between said dynamic pump and said boiler to regulate the liquid flow rate to the latter;

sensing said liquid level within said steam receptacle; and draining liquid from said steam receptacle to said low pressure source in response to said sensed liquid level;

utilizing pump means responsive to said supply of pressurized liquid from said dynamic pump to said boiler for recirculating liquid from said steam receptacle means through the remainder of said boiler;

utilizing a jet pump to define said pump means;

utilizing a nozzle of said jet pump to define said flow-restricting orifice;

employing said jet pump nozzle to form said supply of pressurized liquid into a relatively high velocity liquid jet;

utilizing said liquid jet entrain liquid from said steam receptacle for recirculating same through the remainder of said boiler;

conserving thermal energy carried from said steam receptacle toward said low pressure source by liquid draining from the former toward the latter by transferring said thermal energy to said supply of pressurized liquid; and conserving pressure energy carried from said steam receptacle toward said low pressure source by liquid draining from the former toward the latter by using said pressure energy to induce liquid flow from said low pressure source to said dynamic pump.

17. The method of claim 16 wherein said step of conserving pressure energy includes the steps of forming pressurized liquid draining from said steam recepticle toward said low pressure source into an other relatively high velocity liquid jet, and utilizing said other high velocity liquid jet to entrain and pressurize liquid from said low pressure source for delivery to said dynamic pump.

18. The method of claim 17 further including the step of adjusting said other high velocity liquid jet in response to the vapor pressure level within said steam recepticle means.

19. The method of claim 17 including the step of utilizing a jet type pump interposed between said low pressure source and said dynamic pump to form said other high velocity liquid jet and to entrain liquid from said low pressure source with said other liquid jet.

20. In a apparatus having heat exchange means for placing a liquid in heat exchange relation with a heat source, collecting means in association with said heat exchange means for receiving heated liquid therefrom and collecting the vapors resulting from boiling of said liquid, and liquid feed pump means for pressurizing liquid from a relatively low pressure source thereof and for delivering a flow of said pressurized liquid to said heat exchange means, the method of providing for recirculation of heated liquid from said collecting means to said heat exchange means, said method comprising the steps of: utilizing a circulating pump capable of being powered by a flow of pressurized liquid; providing for said circulating pump to receive liquid from said collecting means and to discharge said liquid to said heat exchange means; and utilizing said flow of pressurized liquid from said feed pump means to power said circulating pump; further including the steps of: using two pumps in liquid flow series to substantially define said liquid feed pump means, one of said two pumps including a substantially constant speed dynamic pump whose fluid flow rate is inversely dependent upon the fluid pressure differental thereacross, the other of said two pumps including a jet pump having an inlet receiving a first flow of liquid from said low pressure source, said jet pump also including a high pressure inlet receiving a second flow of liquid from said collecting means and an outlet delivering said first and said second flows together to said dynamic pump; and adjusting the flow rate of said second flow in dependence upon the fluid pressure level within said collecting means thereby to adjust the flow rate of said first flow.

21. In an apparatus having a boiler with a steam drum, and a liquid feed pump providing a flow of pressurized liquid to said boiler, the method of providing liquid recirculation within said boiler comprising the step of using said flow of pressurized liquid to power liquid recirculation from said steam drum through the remainder of said boiler and back to said steam drum; utilizing a jet type pump to induce said liquid recirculation; utilizing said flow of pressurized liquid to power said jet type pump; and utilizing as said liquid feed pump a dynamic type pressure generating pump inherently providing a flow rate of said pressurized liquid flow to said boiler which varies inversely according to the liquid pressure differential across said pump.

22. The method of claim 21 including the step of directing said flow of pressurized liquid through a nozzle of said jet type pump, said nozzle inherently limiting said pressurized liquid flow rate directly according to the liquid pressure differential across said nozzle.

23. The method of claim 22 further including the step of sensing the liquid level within said steam drum, and draining excess liquid from said steam drum in response to said sensed liquid level.

24. The method of claim 23 including the step of utilizing a portion of said excess liquid from said steam drum to induce liquid flow from a relatively low pressure source thereof to said dynamic liquid feed pump.

25. The method of claim 24 including the step of flowing said portion of said excess liquid through a jet type pump to induce said liquid flow from said low pressure source to said dynamic liquid feed pump.

26. The method of claim 25 including the further step of adjusting said portion of excess liquid in response to fluid pressure within said steam drum.

27. A steam generating apparatus including a jet pump defining an inlet receiving a first flow of liquid from a low pressure source thereof, a high pressure inlet receiving a second flow of liquid from a pressurized steam drum of said apparatus, and an outlet discharging said first and said second flows together to a liquid feed pump, said liquid feed pump supplying said first and said second liquid flows pressurized to a boiler portion of said apparatus, said apparatus further including valve means controlling said second liquid flow in dependence upon the fluid pressure level within said steam drum.

28. A steam generating apparatus according to claim 27 further including a steam turbine receiving a flow of pressurized vapor from said steam drum, said steam engine including a continuously open fixed-area nozzle assembly through which said vapor flows.

29. The invention of claim 28 wherein said nozzle assembly operates as a choked nozzle at all differential steam pressures thereacross which exceed a relatively low value.

30. The invention of claim 27 further including a liquid level sensor operatively associated with said steam drum to produce an output signal in response to a liquid level within the latter, and a valve controlling liquid flow from said steam drum to said low pressure liquid source in dependence upon said sensor output signal.

31. The invention of claim 30 wherein said output signal produced by said liquid level sensor is of a step function, on-off type.

32. The invention of claim 31 wherein said liquid level sensor produces said output signal whenever the liquid level within said steam drum reaches a predetermined level.

33. The invention of claim 30 wherein both said sensor and associated valve are of the step function, on-off type.

34. The invention of claim 27 wherein said valve means is disposed within said jet pump.

35. The invention of claim 34 wherein said valve means includes a member defining a nozzle of said jet pump, said nozzle having a nozzle aperture defining an effective liquid flow area through which flows said second liquid flow, said valve means further including a valve element movable relative to said nozzle aperture to adjust the effective liquid flow area defined thereat.

36. The invention of claim 35 wherein said valve means further includes means defining a resilient variable-volume chamber operatively coupled with said valve element, resilient means biasing said valve element to a first position wherein said effective liquid flow area is a maximum value, and flow path means exposing said variable-volume chamber substantially to fluid pressure within said steam drum.

37. The invention of claim 36 wherein said variable volume chamber is annular and is defined by the cooperation of a pair of coannular resilient bellows members.

38. The invention of claim 37 wherein said valve element is carried by an elongate movable stem member, said stem member also carrying a first transverse radial flange, said valve means also including a second transverse radial flange spaced axially from said first flange, said pair of bellows members extending axially between and sealingly coupling with said first and said second radial flanges.

39. The invention of claim 38 wherein said stem member further carries a transverse radial spring seat, said valve means defining a third radial flange, and said resilient means comprising a coil spring extending between said spring seat and said third radial flange.

40. The invention of claim 39 wherein said valve means comprises a streamlined body disposed within said jet pump and within said nozzle member between the high pressure inlet of the former and the nozzle aperture of the latter; said streamlined body housing said valve element, said variable-volume chamber, and said resilient means.

41. The invention of claim 40 wherein said streamlined body is supported within said jet pump by a plurality of struts extending therebetween.

42. A vapor pressure engine comprising:

a boiler having an inlet and an outlet and being substantially filled with pressurized liquid, said boiler placing said pressurized liquid in heat exchange relation with a source of heat;

a vapor drum communicating with said boiler outlet to receive a mixed flow of heated liquid and the saturated vapor resulting from boiling of said liquid, said heated liquid filling said vapor drum to a determinate level and the remainder to said steam drum being filled with said vapor;

a super heater receiving a first flow of saturated vapor from said vapor drum, said super heater placing said first flow of vapor in heat exchange relation with said source of heat to convert said saturated vapor to superheated vapor;

a fluid pressure operated motor receiving said first flow of superheated vapor and producing shaft power by expansion of said vapor to a relatively low pressure and temperature, said motor including a substantially continuously open fixed-area nozzle assembly controlling the fluid flow rate of said first flow directly according to the fluid pressure in said steam drum;

a condenser receiving said first flow of vapor from said motor, said condenser placing said vapor in heat exchange relation with a heat absorber to condense said expanded vapor to liquid;

a liquid well receiving said liquid from said condenser;

a first jet pump receiving a second flow of liquid from said liquid well and a third flow of pressurized liquid from said vapor drum for admixture with said second liquid flow to increase the pressure thereof, said mixed second and third liquid flows forming a fourth pressurized liquid flow;

control means in association with said first jet pump for controlling the flow rate of said second and third liquid flows as a function of fluid pressure in said vapor drum;

a dynamic liquid pump having a substantially constant speed of operation and receiving said fourth liquid flow to increase the pressure thereof to a level greater than the fluid pressure in said vapor drum, the flow rate of said fourth liquid flow through said dynamic pump inherently being inversely related to the fluid pressure differential across the latter; and a second jet pump receiving a fifth flow of heated and pressurized liquid from said vapor drum and receiving said fourth liquid flow for admixture with said fifth liquid flow to increase the pressure thereof, said mixed fourth and fifth liquid flows forming a sixth liquid flow at a fluid pressure higher than that in said vapor drum, said second jet pump communicating said sixth liquid flow to said boiler inlet.

43. The invention of claim 42 wherein said control means includes a valve element movable in response to the fluid pressure level within said vapor drum to adjust said third liquid flow rate to thereby adjust said second liquid flow rate.

44. The invention of claim 43 wherein said control means includes means for defining a resilient variable-volume chamber operatively connected with said valve element, and flow path means for exposing said chamber defining means substantially to fluid pressure within said vapor drum to move said valve element in response thereto.

45. The invention of claim 44 wherein said first jet pump includes said control means.

46. The invention of claim 45 wherein said control means defines a nozzle member of said frrst jet pump, said nozzle member defining a nozzle aperture through which flows said third liquid flow, said valve element moving relative to said nozzle aperture to control the flow rate of said third liquid flow.

47. The invention of claim 46 wherein said first jet pump defines an inlet leading to a chamber and receiving therein said second liquid flow, said nozzle member directing said third flow across said chamber as a high velocity jet directed toward an outlet of said first jet pump, said high velocity jet entraining said second liquid flow and flowing therewith from said outlet.

48. The invention of claim 47 wherein said first jet pump further defines a high pressure inlet receiving said third liquid flow, said control means being disposed within said high pressure inlet.

49. The invention of claim 48 wherein said first jet pump includes a streamlined body disposed within said high pressure inlet and housing said control means.

50. The invention of claim 42 wherein said dynamic liquid pump is of the centrifugal type.

* * * * *